US008297203B2

(12) United States Patent
Stiedl

(10) Patent No.: US 8,297,203 B2
(45) Date of Patent: Oct. 30, 2012

(54) RAIL VEHICLE HAVING HEIGHT ADJUSTMENT FOR A FLOOR PLATE

(75) Inventor: Hans Stiedl, Rheinberg (DE)

(73) Assignee: Siemens Aktiengesellschaft, Munich (DE)

( * ) Notice: Subject to any disclaimer, the term of this patent is extended or adjusted under 35 U.S.C. 154(b) by 0 days.

(21) Appl. No.: 13/055,564

(22) PCT Filed: Jun. 23, 2009

(86) PCT No.: PCT/EP2009/057806

§ 371 (c)(1),
(2), (4) Date: Jan. 24, 2011

(87) PCT Pub. No.: WO2010/009946

PCT Pub. Date: Jan. 28, 2010

(65) Prior Publication Data

US 2011/0126733 A1 Jun. 2, 2011

(30) Foreign Application Priority Data

Jul. 23, 2008 (DE) ..... 10 2008 034 307

(51) Int. Cl.
*B61D 17/10* (2006.01)

(52) U.S. Cl. ..... 105/422; 105/375

(58) Field of Classification Search ..... 105/375, 105/422; 404/26

See application file for complete search history.

(56) References Cited

U.S. PATENT DOCUMENTS

| | | | | |
|---|---|---|---|---|
| 1,302,578 | A * | 5/1919 | Murphy | 52/402 |
| 4,794,032 | A * | 12/1988 | Fujii et al. | 428/209 |
| 5,113,769 | A * | 5/1992 | Okuno et al. | 105/422 |
| 5,339,745 | A * | 8/1994 | Ritzl et al. | 105/452 |
| 5,595,123 | A * | 1/1997 | Tao et al. | 105/396 |
| 6,668,733 | B1 * | 12/2003 | Martens et al. | 105/422 |
| 6,708,626 | B2 * | 3/2004 | Ueda et al. | 105/452 |
| 8,070,004 | B2 * | 12/2011 | Williams et al. | 220/1.5 |
| 2010/0126376 | A1 * | 5/2010 | Williams et al. | 105/422 |
| 2011/0126733 | A1 * | 6/2011 | Stiedl | 105/422 |

FOREIGN PATENT DOCUMENTS

| | | | |
|---|---|---|---|
| DE | 8909751 | U1 | 10/1989 |
| EP | 0576394 | A1 | 12/1993 |
| WO | 0055510 | A1 | 9/2000 |
| WO | 0076822 | A1 | 12/2000 |

* cited by examiner

*Primary Examiner* — Jason C Smith

(74) *Attorney, Agent, or Firm* — Laurence A. Greenberg; Werner H. Stemer; Ralph E. Locher

(57) ABSTRACT

A rail vehicle contains a floor plate, which is supported on a shell floor plate with height adjustment elements therebetween. The height adjustment elements have two components arranged one over the other, of which the one rests against the floor plate from below and the other rests against the shell floor plate from above, wherein the two components can be fixed in various positions relative to each other in order to set a total height of the height adjustment elements.

4 Claims, 3 Drawing Sheets

RAIL VEHICLE HAVING HEIGHT ADJUSTMENT FOR A FLOOR PLATE

BACKGROUND OF THE INVENTION

Field of the Invention

The invention relates to a rail vehicle having a foot plate which is supported on a shell floor plate with interposed height adjustment elements.

The background of this height adjustment is that it is necessary to compensate for differences in height between the level foot plate, which is typically made of wood, and the shell floor plate which has a convexity or concavity caused by the tolerances.

To achieve this, it is known to compensate for differences in height using continuous hardwood battens of different heights. This method is considered to be extremely expensive.

BRIEF SUMMARY OF THE INVENTION.

Starting from this point, the object of the invention is to further develop a rail vehicle of the type mentioned at the beginning in such a way that a height adjustment can be effected between the foot plate and the shell floor plate more quickly.

This object is achieved by the height adjustment elements having two components arranged one above the other, one of which bears against the foot plate from below and the other bears against the shell floor plate from above, wherein the two components can be fixed in different positions relative to each other to set a total height of the height adjustment elements.

In this way, using very simple means, the possibility is created of effecting a height adjustment by changing the positions of the two components relative to each other.

The two components of the height adjustment elements can each be designed as essentially wedge-shaped and arranged in such a way that their oblique sides bear on each other and can be shifted relative to each other, means being provided for fixing the two components against each other when a desired total height for the height adjustment elements has been obtained. It is evident that the wedge shape for the two components is a particularly favorable option for achieving different relative positions of these components with a different total height of the height adjustment element being produced in each case.

It is advantageous for fixing the two components in a desired position relative to each other if they can be hooked to each other in different positions shifted against each other. Alternatively, plug-in solutions may also be conceivable.

In detail, it can advantageously be provided that the lower component has a plurality of hooks aligned with one another in a central region of its oblique side, and the upper component has at least one hook for engaging with one of the hooks of the lower component, the respective hooks being arranged transversely to their associated components of the height adjustment elements. This means that the hooks provided are extended substantially transversely to the components so that a secure engagement between the two components can be effected which, in particular, also prevents the upper component from undesirably lifting off from the lower one.

The height adjustment elements can preferably be formed from aluminum profiles or plastic profiles for the components. This has the advantage that no moisture is absorbed and rot is hence effectively prevented.

To fix a height adjustment element on the shell floor plate situated below, it can be provided that the lower component is adhesively bonded to the shell floor plate. The use of double-sided adhesive tape or also thin-bed adhesive bonding can, for example, be considered.

An exemplary embodiment of the invention is explained in more detail below with reference to the drawings, in which:

DESCRIPTION OF THE INVENTION.

Figure 1:
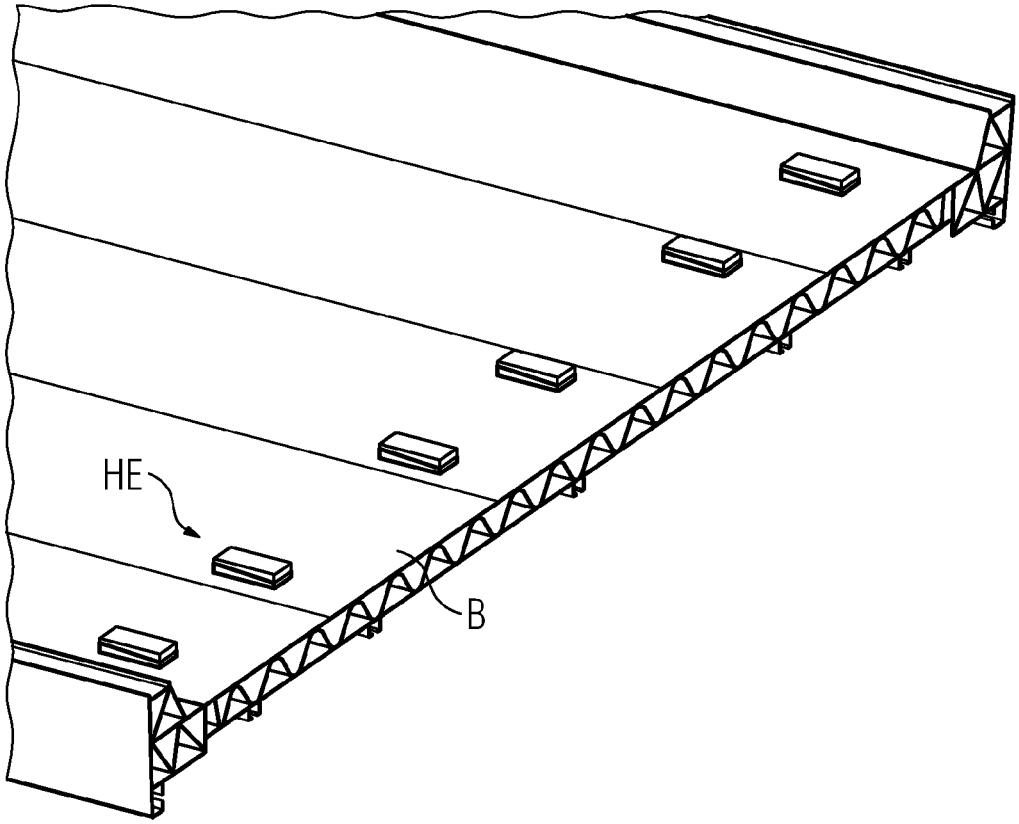
FIG. 1 shows a perspective view of a plurality of height adjustment elements on a shell floor plate.

It is apparent from FIG. 1 that height adjustment elements HE, six in the present case, are arranged next to one another transversely to a shell floor plate. A foot plate of a rail vehicle, to which the shell floor plate B belongs, is to be arranged above the height adjustment elements HE. In a practical embodiment, further rows of height adjustment elements HE are to be provided in the longitudinal direction of the shell floor plate B.

It can be seen already from FIG. 1 that the individual height adjustment elements HE are constructed from an upper component OK and a lower component UK, the lower component UK being connected to the shell floor plate in a suitable fashion, for example by adhesive bonding.

Figure 2:
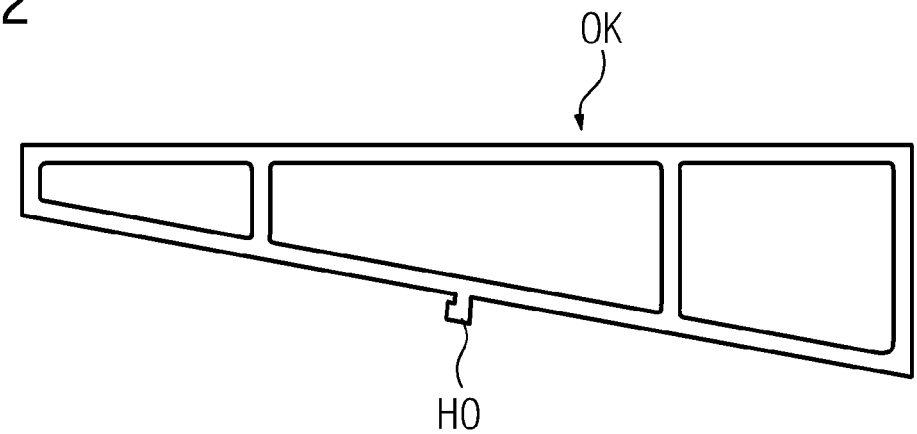
FIG. 2 shows a cross sectional view of an upper component of a height adjustment element.
Figure 3:
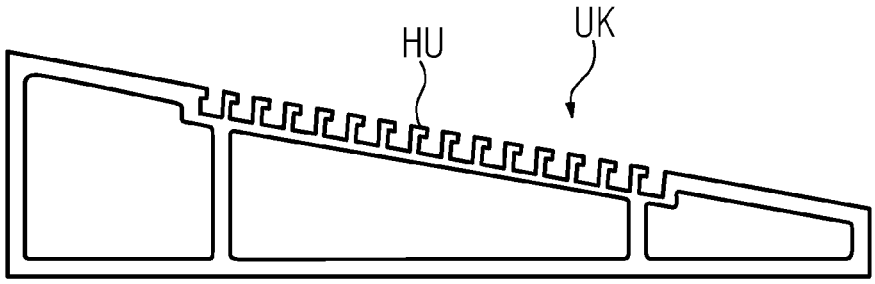
FIG. 3 shows a cross sectional view of a lower component of a height adjustment element.

Now cross sectional views of the upper component OK and the lower component UK are shown in FIGS. 2 and 3. Both components OK, UK have a general wedge shape in cross section. However, the cross sections of the upper component OK and the lower component UK here do not taper to a point but are bounded on both sides by vertical surfaces so that, cf. FIG. 4, an overall parallelepipedal part results when the upper component OK and the lower component UK are superposed.

As can be seen from FIG. 2, an oblique side of the upper component OK has, at its approximate center, a hook HO that extends perpendicularly to the plane of the drawing. The hook HO projects from the oblique side of the upper component OK in the direction of the surface normal.

In the case of the lower component UK of the height adjustment element HE, in the region of its oblique side a plurality of hooks HU are provided which extend transversely to the lower component UK and the end surfaces of which lie in the plane of the oblique side of the lower component UK. The hooks HU have a fixed pitch and extend from a center of the oblique side in both directions. Recesses located between two adjacent hooks HU of the lower component UK are dimensioned such that the hook HO of the upper component OK can in each case engage there.

Figure 4:
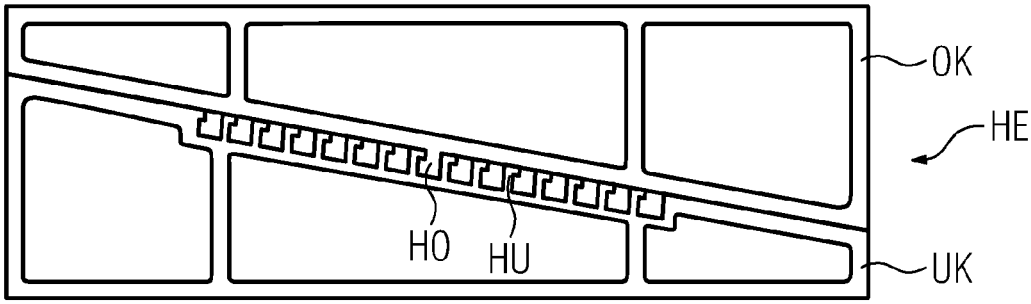
FIG. 4 shows a cross sectional view of a height adjustment element with the two components in a starting position.

Now, FIG. 4 shows the height adjustment element HE in a starting position in which the hook HO engages in a central recess of the lower component UK. The engagement between the upper component and the lower component ensures that the upper component OK cannot lift off from the lower component UK.

Figure 5:
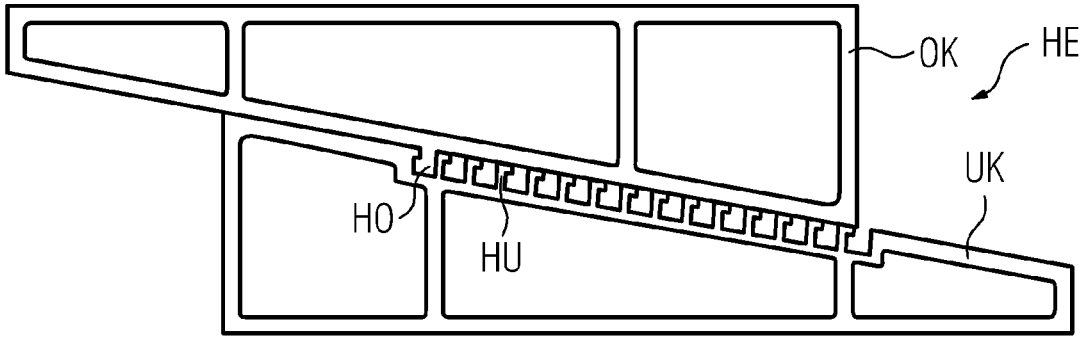
FIG. 5 shows a cross sectional view of the height adjustment element from FIG. 4 with the two components in an arrangement with the maximum total height.
Figure 6:
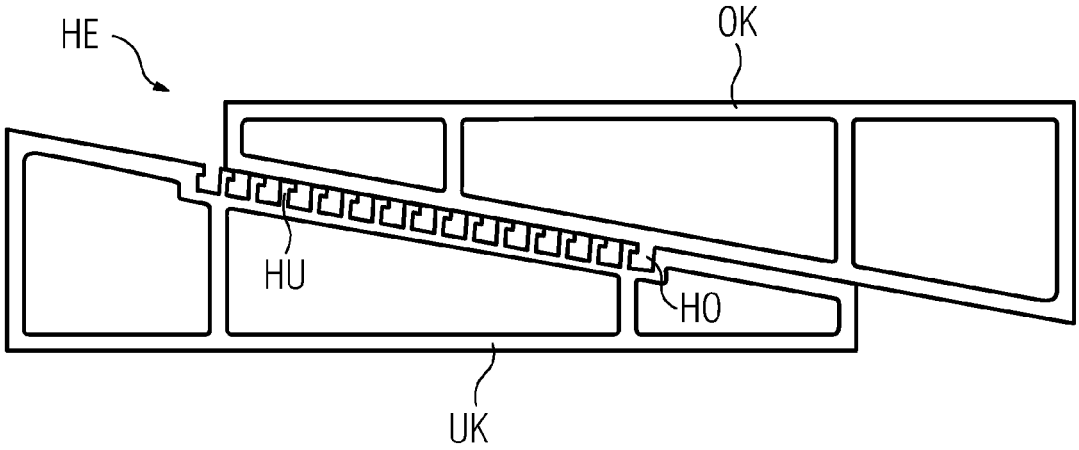
FIG. 6 shows a cross sectional view of the height adjustment element from FIG. 4 with the two components in an arrangement with the minimum total height of the height adjustment element.

FIGS. 5 and 6 show further relative positions between the upper component OK and the lower component UK of the height adjustment element HE. FIG. 5 here concerns a maximum height of the height adjustment element HE in which the hook HO engages in the highest recess of the lower component UK. In contrast, FIG. 6 shows an engagement of the hook HO in the lowest recess between two hooks HU of the lower component UK.

Step heights in the region of 0.8 mm can be readily achieved by suitable dimensioning of the two components OK, UK.

The height adjustment elements HE consist of aluminum or plastic profiles so that they are not susceptible to the effect of moisture.

The invention claimed is:

1. A rail vehicle, comprising a shell floor plate;

height adjustment elements each having two components disposed one above the other; and a foot plate supported on said shell floor plate by interposed said height adjustment elements, one of said components bears against said foot plate from below and another of components bears against said shell floor plate from above, said two components being fixed in different positions relative to each other to set a total height of said height adjustment elements, said two components being wedge-shaped with oblique sides and disposed for having said oblique sides bear on each other and for being shifted relative to one another, said two components including a lower component having a plurality of hooks aligned with one another in a central region of said oblique sides and an upper component having at least one hook for engaging with one of said hooks of said lower component, said hooks being disposed transversely to said components of said height adjustment elements, said hooks for fixing said two components against one another in different positions when a desired total height for said height adjustment elements has been obtained.

2. The vehicle according to claim 1, wherein said components are selected from the group consisting of aluminum profiles and plastic profiles.

3. The vehicle according to claim 1, wherein said lower component of said height adjustment elements is adhesively bonded to said shell floor plate.

4. A rail vehicle, comprising a shell floor plate;

height adjustment elements each having two components disposed one above the other; and a foot plate supported on said shell floor plate by interposed said height adjustment elements, one of said components bears against said foot plate from below and another of components bears against said shell floor plate from above, said two components being fixed in different positions relative to each other to set a total height of said height adjustment elements, said two components being wedge-shaped with oblique sides and disposed for having said oblique sides bear on each other and for being shifted relative to one another, said two components including a first component having a plurality of hooks aligned with one another in a central region of said oblique sides and a second component having at least one hook for engaging with one of said hooks of said first component, said hooks being disposed transversely to said components of said height adjustment elements, said hooks for fixing said two components against one another in different positions when a desired total height for said height adjustment elements has been obtained.

* * * * *